US007637730B2

(12) United States Patent
Herda

(10) Patent No.: US 7,637,730 B2
(45) Date of Patent: Dec. 29, 2009

(54) NON-ROUND SPINNERET PLATE HOLE

(75) Inventor: Eduard Herda, Peine (DE)

(73) Assignee: Fiberweb Corovin GmbH (DE)

( * ) Notice: Subject to any disclaimer, the term of this patent is extended or adjusted under 35 U.S.C. 154(b) by 710 days.

(21) Appl. No.: 10/534,451

(22) PCT Filed: Nov. 11, 2003

(86) PCT No.: PCT/EP03/12540

§ 371 (c)(1),
(2), (4) Date: Nov. 10, 2005

(87) PCT Pub. No.: WO2004/044283

PCT Pub. Date: May 27, 2004

(65) Prior Publication Data

US 2006/0121146 A1 Jun. 8, 2006

(30) Foreign Application Priority Data

Nov. 12, 2002 (DE) ..... 102 52 414

(51) Int. Cl.
*A01J 21/02* (2006.01)

(52) U.S. Cl. ..... 425/131.5; 425/378.2; 425/379.1; 425/382 R; 425/382.2; 425/461

(58) Field of Classification Search ..... 425/131.5, 425/378.2, 379.1, 382 R, 382.2, 461
See application file for complete search history.

(56) References Cited

U.S. PATENT DOCUMENTS

| | | | | |
|---|---|---|---|---|
| 3,718,534 | A * | 2/1973 | Okamoto et al. | 428/374 |
| 4,357,290 | A * | 11/1982 | Yu | 264/147 |
| 4,812,361 | A * | 3/1989 | Takemoto et al. | 428/397 |
| 5,125,818 | A * | 6/1992 | Yeh | 425/131.5 |
| 5,208,107 | A * | 5/1993 | Yeh et al. | 428/397 |
| 5,393,219 | A * | 2/1995 | Hagen et al. | 425/382.2 |
| 6,746,230 | B2 * | 6/2004 | Travelute et al. | 425/382.2 |
| 2001/0055682 | A1 * | 12/2001 | Ortega et al. | 428/371 |
| 2006/0012072 | A1 * | 1/2006 | Hagewood et al. | 264/176.1 |

FOREIGN PATENT DOCUMENTS

| | | |
|---|---|---|
| JP | 01 020315 A | 1/1989 |
| JP | 2003 138464 A | 5/2003 |
| WO | WO 03/016606 A | 2/2003 |

* cited by examiner

*Primary Examiner*—Joseph S. Del Sole
*Assistant Examiner*—Timothy Kennedy
(74) *Attorney, Agent, or Firm*—Alston & Bird LLP

(57) ABSTRACT

The present invention concerns a spinneret plate (1) for manufacturing a nonwoven fabric, having multiple non-round holes, which are similar to trilobal or multiarmed holes (3) in particular, for polymer flow outlet to produce filaments, in which identical holes are positioned in rows offset relative to one another. At least a first row (2) has a positional arrangement of the holes that differs from the positional arrangement of a second row (7) of rows through rotation of the holes.

6 Claims, 4 Drawing Sheets

NON-ROUND SPINNERET PLATE HOLE

CROSS REFERENCE TO RELATED APPLICATIONS

This application is a national stage application fined under 35 U.S.C. 371 of International Application No. PCT/EP03/12540, filed Nov. 11, 2003, which claims priority to German Application No. DE 102 52 414.9, filed Nov. 12, 2002.

FIELD AND BACKGROUND OF THE INVENTION

The present invention relates to a spinneret plate for manufacturing a nonwoven fabric, having multiple non-round holes, which are similar to trilobal or multiarmed holes in particular, for polymer flow outlet to produce filaments, identical holes being positioned in rows offset with respect to one another.

Methods are known for producing filaments having a non-round cross section in the manufacture of nonwoven fabrics. This cross section may be, for example, trilobal, i.e. the cross section has three arms that are connected to each other at a centre. It is also possible to create, for example, star-shaped or other non-round cross sections. For example, a method is known from German Patent No. DE 36 341 46 A1 for creating a nonwoven, fibrous fabric using a spinneret plate in which the spinneret plate is furnished with "bilobal" holes. These bilobal holes each consist of two circular apertures which are connected with one another by a connecting element. German Patent No. DE 36 341 46 A1 further describes other slot geometries that are known in the related art and used in spinneret plates. These may have the form of slit-shaped, triangular, half-moon, or also T-shaped apertures in spinneret plates.

SUMMARY OF THE INVENTION

The object of the present invention is to ensure that non-round filaments having uniform properties are produced that may be used in manufacturing a nonwoven fabric.

This object is achieved with a spinneret for manufacturing a nonwoven fabric having multiple non-round holes, which are of a trilobal or multiarmed cross section.

A spinneret plate for manufacturing a nonwoven fabric has multiple non-round holes, which are similar to trilobal or multiarmed holes, for polymer flow outlet to produce filaments. The spinneret plate has identical holes in rows that are offset with respect to each other. A first row has a positional arrangement of the holes which differs from the positional arrangement of a second row of holes through rotation of the holes. A uniformly shaped, directed blowing of the polymer material exiting each hole may be achieved by rotation of the holes. Blowing is effected particularly using a cooling gas, which is upon impinging for example perpendicularly on the polymer material being discharged. The cooling gas may also be upon impinging at an inclined angle, thereby causing the polymer material to be stretched during production of the filaments. An approximately similar blowing, for example with a cooling gas through holes that are arranged one behind the other, may be achieved by rotating the holes.

According to an improvement, rows of holes may be placed in more than just one different positional arrangement by rotation of the holes. Instead, the holes may also be arranged offset with respect to each other. This means that for example holes in a first row as seen from the blowing direction do not obscure holes in a second row that are arranged behind them. Instead, the holes of at least this second row are also surrounded by cooling gas that has not yet been diverted by other polymer material.

One refinement provides that the spinneret plate has different types of holes. The facility to rotate the holes means that blowing may be kept uniform even if the holes have differing cross sections. This in turn influences the properties of the filaments. Rotation may be synchronised with the cross section of the holes, blowing conditions, flow rate of the polymer and other parameters so that the properties of the filaments may be adjusted in a targeted manner. This may be used for example to modify the longitudinal or transverse mechanical strength of the filaments, their opacity and other properties.

Another provision envisages that the spinneret plate is divided into at least two regions, and that the first region and the second region are each furnished with two or more rows of identical holes. In particular, one region only has holes of a certain dimensioning and/or geometry. The regions are preferably separated from each other, for example by a gap that extends between the holes of different regions. In particular, the separation between holes of a region is the same size or smaller than the gap between two regions. This allows a number of additional possibilities. On the one hand, a certain separation, and thus also a certain bundling of filaments may be obtained, which bundling is reflected subsequently for example in the nonwoven fabric. On the other hand, a larger separation between different regions enables processes to take place in this gap that would be disruptive for the filament manufacturing process if they were performed in other areas of the spinneret plate. For example, the gap may be used as a mixing zone for different cooling flows. In particular, the holes between the regions may be rotated and preferably also offset with respect to each other. An improvement provides that the first region has a positional arrangement of the holes which is rotated by 180° relative to the positional arrangement of the holes in the second region. This symmetrical inversion of the positional arrangement of the holes with respect to each other enables blowing to take place in uniform manner, especially if the spinneret plate is blown with a cooling gas from two sides. In this way, it is possible to ensure that comparable rows of different regions are blown in at least an approximately similar manner, so that filaments are also formed similarly.

A further provision of the invention envisages that a spin packet including at least a first and a second spinneret plate is provided, the first and second spinneret plates being positioned neighboring one another in the spin packet. The first and the second spinneret plates each have non-round holes, the holes in the first spinneret plate being positioned rotated in relation to the holes in the second spinneret plate. The advantage of this arrangement is that the construction of spinneret plates for a spin packet is the same. However, then the spinneret plates are installed, they are offset with respect to one another. As a result, it is possible to proceed preferably with manufacturing equipment and manufacturing jigs that already exist.

The spin packet preferably has an installation protection cooperating with the respective spinneret plates. This installation protection ensures that the spinneret plates may also be installed only in the positions to which they are allocated. This installation protection may be provided for example using tongue and groove connections between the spinneret plates and the spin packet. This modular construction of the spin packet also enables different spinneret plates to be used in combination. This in turn allows of a wide variety of variants in terms of the geometries, rotations and also offsets of the holes with respect to each other in the spin packet.

According to a further refinement, multiple spinneret plates are positioned neighboring one another in the spin packet, each of the spinneret plates having only a certain number of rows of holes. For example, one spinneret plate has 15 or fewer, particularly 10, preferably 5 and fewer holes.

This enables the positional arrangement of the holes for example to be rotated a little farther from one spinneret plate to the next, for example. It is then also possible for correspondingly suitable positional arrangements of the holes and therewith also angles of rotation to be set for different blowing behaviors of the spinneret plates without the need to produce entirely new spinneret plates. Moreover, with the arrangement of different spinneret plates in the spin packet, it is possible use combinations of different types of holes depending on the intended use of the nonwoven fabric to be manufactured. Thus for example the first and/or the second spinneret plate may each include various types of holes. In this way, a wide variety of different holes may be used in combination in one spin packet. This may then be implemented advantageously if various properties, such as the fabric layer's insulating behaviour, the liquid absorbency of the nonwoven fabric to be produced, or even a liquid-repellent property of the fabric, are to be set in a specific manner by means of the different cross sections, including the use of filament cross sections appropriate to the purpose.

A further provision of the invention envisages a method of cooling and/or stretching a molten polymer material during spunbonded fabric manufacturing. The polymer material is discharged from multiple non-round holes, which are at least similar to trilobal or multiarmed holes, in at least one spinneret plate. In so doing, the polymer material forms polymer filaments. A first gas flow from a first side and a second gas flow from a second side are each upon impinging on the polymer material as it exits the holes. The first gas flow, at least when it is upon impinging on a first row of polymer filaments, is guided along the shape thereof in mirror image to the guidance of the second gas flow when that is upon impinging on a first row of polymer filaments in the same location. This mirror imaging of the blowing from two separate, especially opposing holes causes the formation of the polymer filaments to become more uniform, so that the properties of the polymer filaments and thus also of the nonwoven fabric also become more homogenous. In addition, this also particularly means for example that the gas flows used may be applied to the polymer filaments at speeds different than those of conventional, opposing gas flows used in producing spunbonded fabrics.

An improvement provides that the first cooling stream and the second cooling stream are guided in mirror image to one another over multiple rows of polymer filaments. To this end, the holes used are preferably constructed as mirror images of each other, and also having the same dimensioning. Preferably, the first and the second gas flows are each deflected at least in part from a first polymer filament row onto a neighboring second polymer filament row. For this purpose rows of holes that are arranged one behind the other are preferably offset with respect to each other. For example, holes may at least partially overlap each other when viewed in the direction of flow. The shape and disposition of the hole may also cause the exiting polymer material to assume a filament cross section that causes the blown gas flow to change direction. A gas flow is preferably deflected by a first polymer filament row onto a subsequent polymer filament row in such manner that the second polymer filament row is also subjected to a directed blowing action.

According to a further provision of the invention, a device for manufacturing spunbonded fabric is created. The device for manufacturing spunbonded fabric has a first and a second gas supply for cooling and/or stretching filaments. The first and the second gas supplies are preferably positioned so that they operate parallel to one another. Preferably, they have at least partially diametrically opposed escape openings. Additionally, the device for manufacturing spunbonded fabric has multiple identical spinneret holes, which have a non-round cross-section. A first region of identically aligned spinneret holes discharges in a blowing region of a first gas fluid escape opening. A second region of identically aligned spinneret holes discharges in a blowing region of the second escape opening of the second gas supply. The first and the second regions are spatially separated from one another, the spinneret holes of the first region being rotated relative to the spinneret holes of the second region such that a polymer material that is discharged from the spinneret holes is subjected to identical blowing in the first region and in the second region.

The filaments produced in this way may then be deposited for example on a travelling screen and processed further. The uniform blowing from at least two sides on holes that are each aligned identically with respect to the direction of blowing further enables for example the gas fluid to be used as a carrier medium. Additives in the gaseous or liquid or solid phase may be mixed into the carrier medium. These additives may modify at least the surface of the filaments.

BRIEF DESCRIPTION OF THE DRAWINGS

Further advantageous configurations and refinements will be explained in detail in the following drawing. The features represented and described therein may be combined with the features described in the foregoing to create yet other configurations of the invention, without the need to specify these individually. In the drawing.

MORE DETAILED DESCRIPTION

Figure 1:
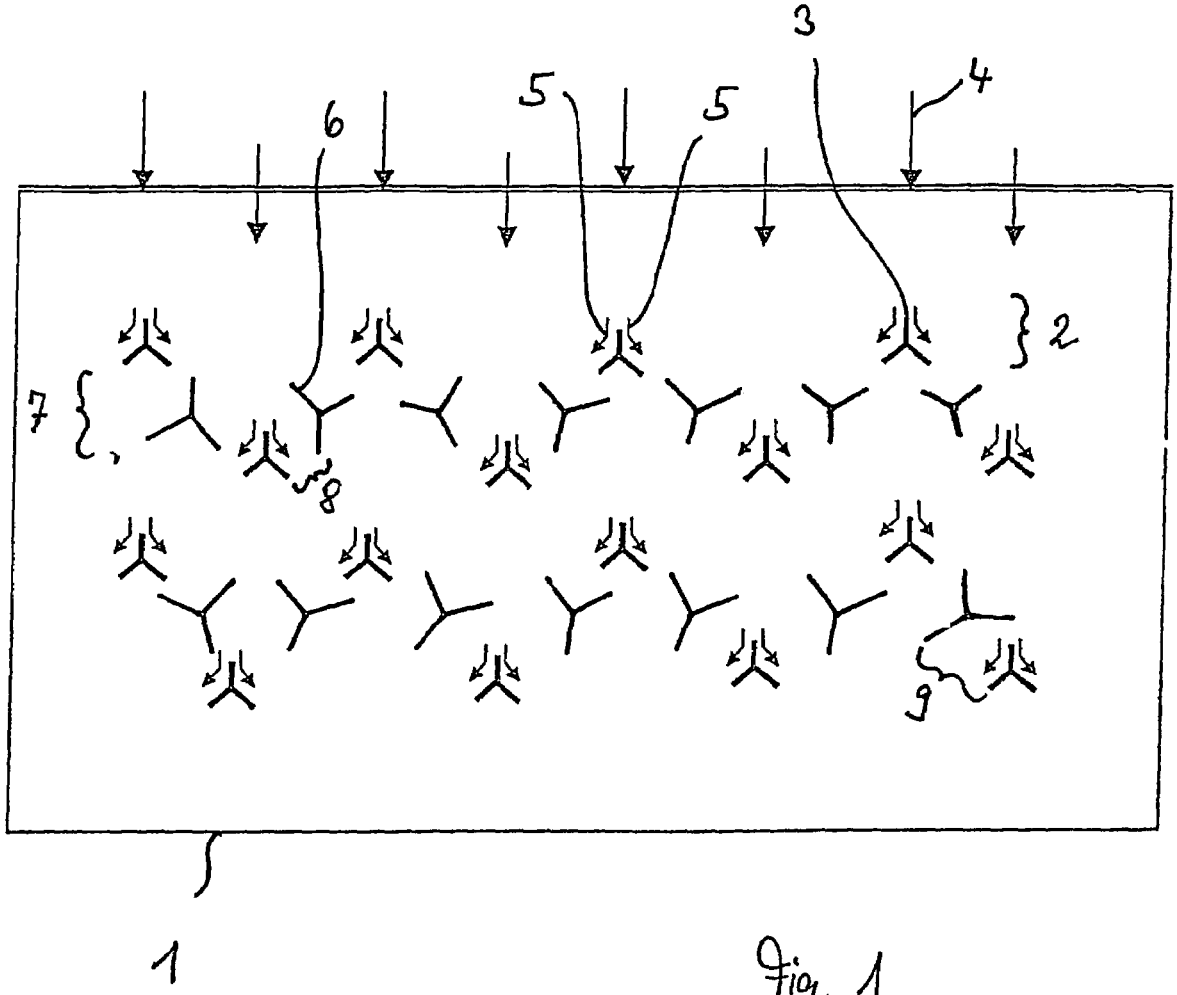
FIG. 1 Shows a first spinneret plate with non-round holes.

FIG. 1 shows a first spinneret plate 1 with a first row 2 of non-round holes 3. Non-round holes 3 have a trilobal cross section. First row 2 is blown by a gas flow, which is indicated by arrows. Non-round holes with trilobal cross-section are arranged in the first row 2 such that one leg extends approximately parallel to the direction of blowing of gas flow 4. In this way, the flow of gas 4 that is upon impinging on a polymer material is split and deflected along the other legs of non-round hole 3. This deflection particularly takes place in such manner that partial flows 5 of gas flow 4 are upon impinging on subsequent second holes 6 of a second row 7 which is arranged behind the first. First non-round holes 3 and the second holes 6 may have the same shape, as shown, but they may also have differing shapes. They may also differ in their dimensions. Second holes 6 in second row 7 are set at an inclined angle relative to those in the first row 2. As is indicated in FIG. 1, the rotation in a row may be uniform for all holes, or it may be varied for different holes. Partial streams 5 are preferably either directly upon impinging on a leg of the holes or are in turn directed approximately parallel to a leg of the subsequent hole, before they are deflected again. In particular, one arrangement of the holes in the first row 2 and the second row 7 may be configured so that turbulence is created at a specific location in gas flow 4 upon impinging on the polymer filaments above spinneret plate 1. In addition, the holes of various rows may be arranged such that a kind of jet effect is produced between neighboring holes. For example, neighboring holes are arranged so that a narrowing 8 is produced, which causes partial flow 5 to accelerate. On the other hand, the option also exists of providing a widening 9. This widening would cause a reduction in the flow speed of partial flow 5. It is also possible to arrange identically aligned holes in rows one behind the other, without interposing a row of holes that is arranged differently.

Figure 2:
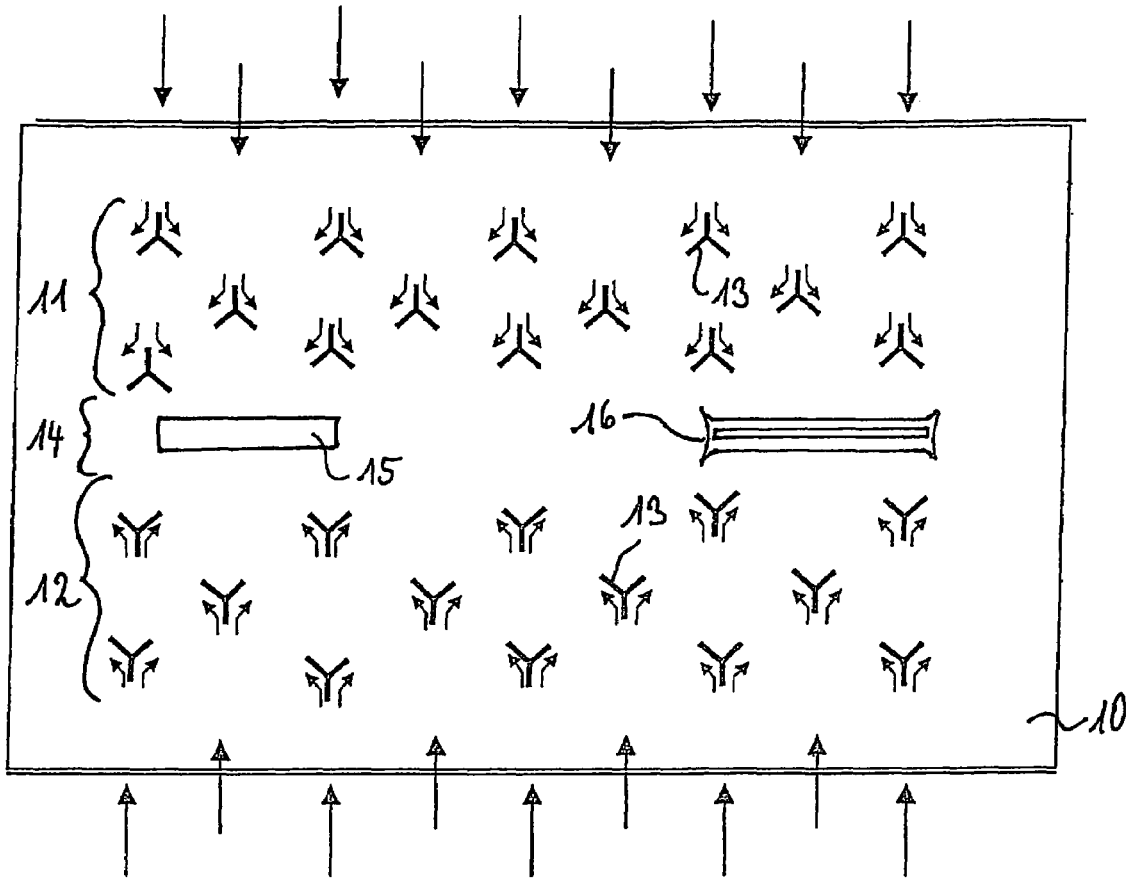
FIG. 2 Shows a second spinneret plate with non-round holes.

FIG. 2 shows a second spinneret plate 10 with a first region 11 and a second region 12. First region 11 is furnished with trilobal holes 13. Second region 12 has identical trilobal holes 13, but the latter are arranged in a mirror image of those in first region 11. A gap 14 is located between first region 11 and second region 12. This gap 14 preferably does not include any holes from which polymer material is discharged to form filaments. However, suction orifices 15 and/or gas flow baffles 16 for example may be situated in the gap. While the gas flow may be drawn inside a spunbonded device via suction orifices 15, the gas flow is deflected by gas flow baffles 16 in such a way that it is redirected towards the point at which the polymer material is discharged from trilobal holes 13.

Figure 3:
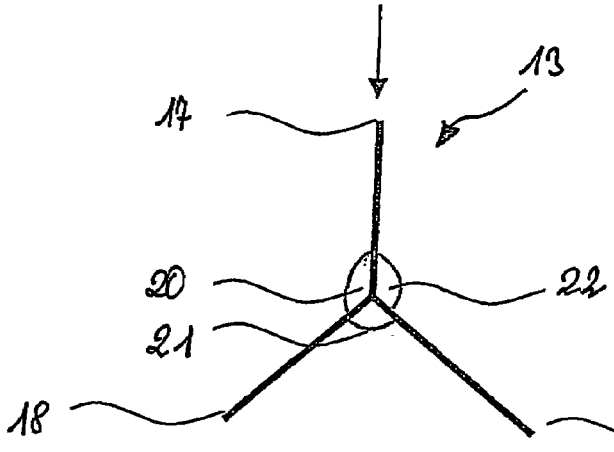
FIG. 3 Shows a cross section of FIG. 2 with a hole as shown in FIG. 2, FIG. 4 Is a plan view of spin packet with two spinneret plates with non-round holes installed in the spin packet and FIG. 5 Is a diagrammatic view of a device for manufacturing spunbonded fabric.

FIG. 3 shows an enlarged trilobal hole 13 according to FIG. 2. Trilobal hole 13 has three arms, a first arm 17, a second arm 18 and a third arm 19. The three arms 17, 18, 19 are preferably arranged with an angle of 120° relative to each of the other two. However, various angle ratios may also be set for the trilobal hole 13. For example, a first angle 20 may be smaller than a second angle 21 and a third angle 22. Preferably however, all trilobal holes 13, not only in one region of the spinneret plate, are aligned in the same direction. Rather, the first arm 17 points in the direction from which the cooling air is flowing, as shown in FIG. 3. This enables a uniform flow of cooling air into the interstitial areas between the fibres, uniform fiber cooling and prevents turbulence or eddies or other disturbances between fibres from different rows. Arms 17, 18, 19 may also be different in length. For example, all three arms 17, 18, 19 be of different lengths, or even only one arm may be longer or shorter. First arm 17 is preferably shorter than second arm 18 and third arm 19. Because the polymer material exiting from first arm 17 is exposed to a cooling air flow on both sides, the temperature falls more quickly there than for the polymer material that exits trilobal hole 13 along second arm 18 and third arm 19. To compensate for this unequal cooling and stretching behaviour, arm 17 for example may be shortened. Moreover, differing geometry of the trilobal hole with respect to the blowing provides the capability to carry out a specific rotation of the filaments produced. For example, the cooling air flow may have the effect of a kind of rotation. It is also possible to achieve a crimping effect on the filaments or fibres thus produced by varying the stretching and/or cooling effects of arms 17, 18, 19.

Figure 4:
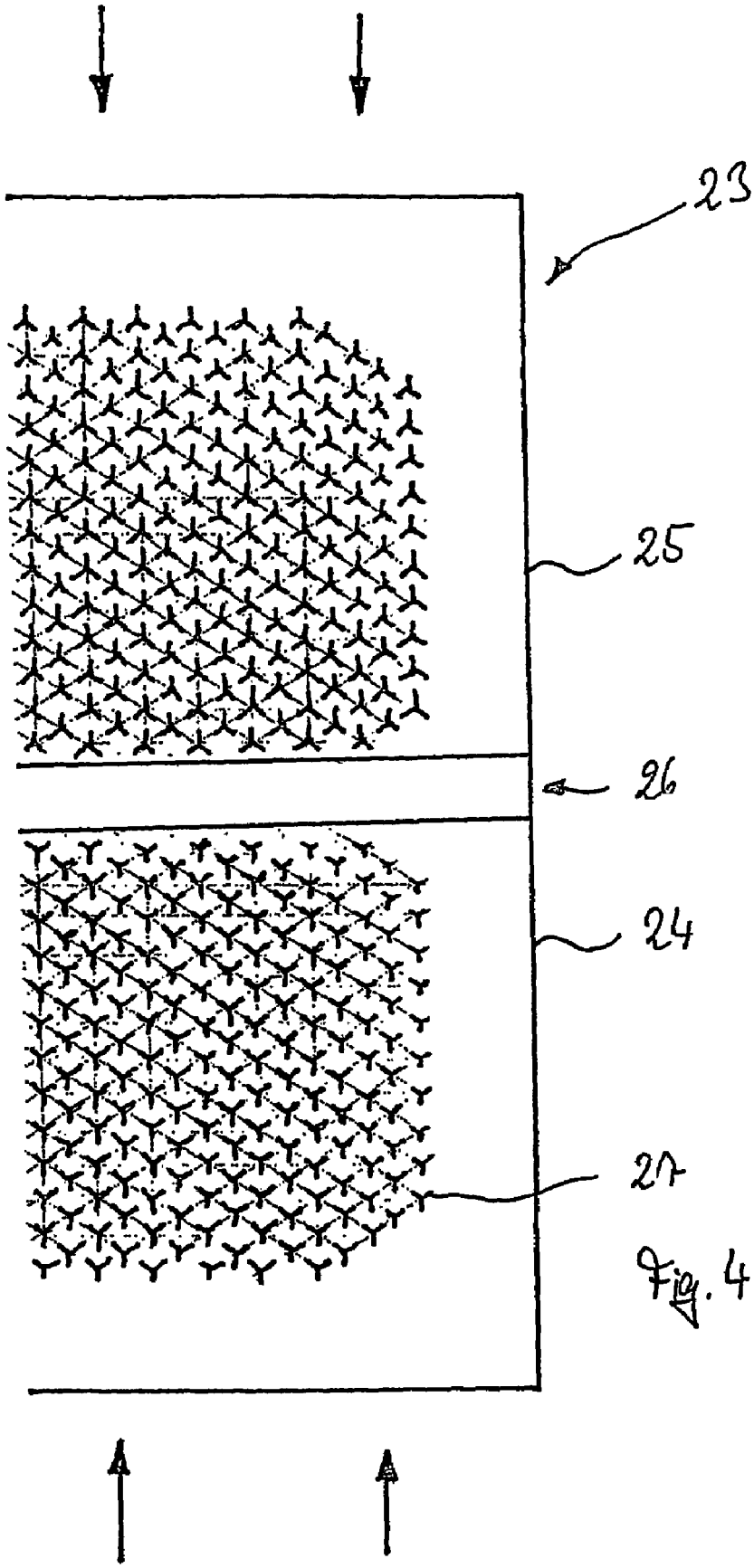

FIG. 4 shows a spin packet 23 with a third spinneret plate 24 and a fourth spinneret plate 25. Both spinneret plates are blown in parallel, but from opposite directions. A gap 26 is also provided between the two spinneret plates 24, 25. Gap 26 preferably creates a separation from 1 to 100 mm, particularly from 5 to 25 mm. Such a separation may also be present in the between different regions of spinneret plate, as shown for example in FIG. 1. Rows of spinneret holes in spinneret plates 24, 25 themselves are preferably separated by a distance that is smaller than gap 26. A spinneret plate or region of a spinneret plate also preferably has 5 to 15 rows of spinneret holes 27.

Figure 5:
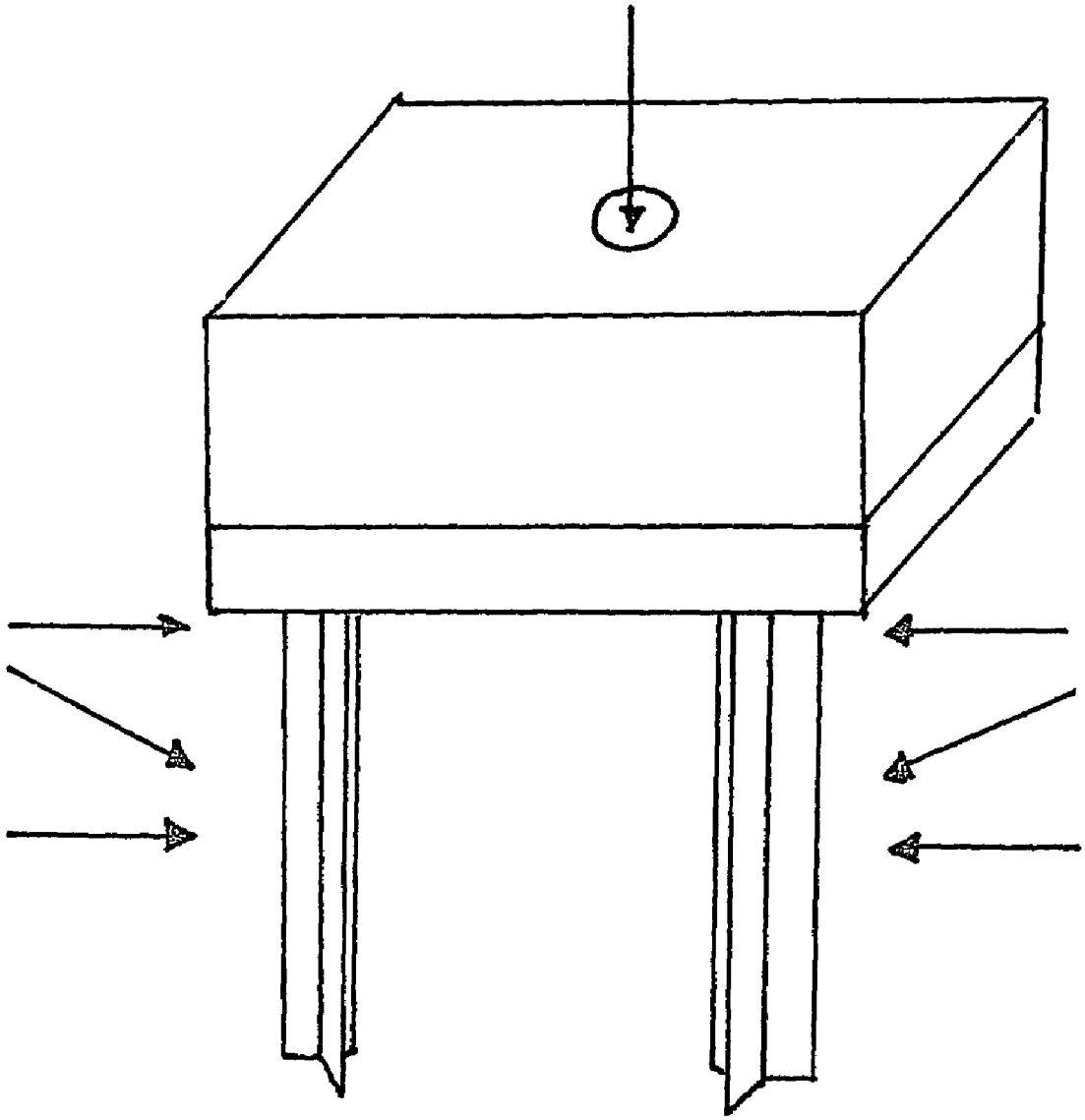

FIG. 5 is a diagrammatic view of a device 28 for manufacturing spunbonded fabric. Device 28 for manufacturing spunbonded fabric 28 includes a single spinneret plate 29. Single spinneret plate 29 includes trilobal holes—not further shown—through which the first polymer filaments 30 and second polymer filaments 31 are discharged. For the sake of clarity, the figure shows only one of each polymer filament, highly enlarged. The trilobal holes in single spinneret plate 29 are arranged so that first polymer filaments 30 are discharged from single spinneret plate 29 with a leg aligned parallel to a first cooling air flow 32. First cooling air flow 32 is indicated by the arrows. The cooling air flow may pass directly below single spinneret plate 29, but may equally well be at a distance therefrom or over an area. At the same time, cooling air flow 32 may pass at right angles to the outflow direction of first polymer filaments 30, or it may also be at an angle inclined thereto. While first polymer filaments 30 are arranged in a first area, second polymer filaments 31 are arranged in a second, separate area. Second polymer filaments 31 are blown by a second cooling air flow 33, and optionally stretched. Second cooling air flow 33 is blown parallel to the first cooling air flow 32. Due to the arrangement according to which the trilobal holes in the first region are mirrored by the trilobal holes in the second region, the polymer filaments produced are cooled more uniformly, and as a consequence the properties of the nonwoven fabric produced from the polymer filaments are also more uniform.

The nonwoven fabric produced using these spinneret plates or such spinneret plates installed in a spin packet is preferably used in sanitary products, household articles, in nonwoven fabrics for technical applications, such as in filter wadding, in the construction industry, in medical applications, for clothing, particularly protective clothing or similar applications. The nonwoven fabric may consist of a single ply or multiple plies, may include different fabric types, may have one or more coating films. The filaments produced may be made from a polyolefin, a polyolefin mixture, for example as a bicomaterial also made from polypropylene and polyethylene. Other geometries may also be used besides the trilobal holes described, for example "c", "u", "v", "L", "*" or more complex shaped holes. One or more different geometry types may be used, and these may be used at least partly in combination with each other and/or separated entirely from each other in separable regions.

The invention claimed is:

1. A spinneret plate for manufacturing a nonwoven fabric, said spinneret plate having multiple non-round holes of a trilobal or multiarmed cross section through which polymer may flow to produce filaments, wherein identically oriented non-round holes are positioned in a first row, and additional non-round holes are positioned in at least one additional row adjacent the first row, wherein the holes of the first row are offset to the holes of the next adjacent row, and wherein the holes of the first row have a positional arrangement which differs from the positional arrangement of the holes of said at least one additional row through rotation of the holes.

2. The spinneret plate according to claim 1, wherein the spinneret plate has at least two different types of holes.

3. The spinneret plate according to claim 1, wherein the spinneret plate is divided into at least two regions, in which the first region and the second region each have two or more rows of identical holes.

4. The spinneret plate according to claim 3, wherein the first region has a positional arrangement of the holes which is rotated by 180° in relation to the positional arrangement of the holes in the second region.

5. The spinneret plate according to claim 3 wherein at least the first region and the second region are separated from one another by a gap.

6. The spinneret plate according to claim 5, wherein the gap is the same size or larger than a distance between two rows of identical holes.

* * * * *

UNITED STATES PATENT AND TRADEMARK OFFICE

CERTIFICATE OF CORRECTION

PATENT NO. : 7,637,730 B2
APPLICATION NO. : 10/534451
DATED : December 29, 2009
INVENTOR(S) : Eduard Herda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1040 days.

Signed and Sealed this

Ninth Day of November, 2010

David J. Kappos

David J. Kappos
*Director of the United States Patent and Trademark Office*